US008998210B2

(12) United States Patent
Shigeta

(10) Patent No.: US 8,998,210 B2
(45) Date of Patent: Apr. 7, 2015

(54) CARD DISPOSAL SYSTEM FOR TABLE GAME

(71) Applicant: Angel Playing Cards Co., Ltd., Osaka (JP)

(72) Inventor: Yasushi Shigeta, Kyoto (JP)

(73) Assignee: Angel Playing Cards Co., Ltd., Osaka (JP)

( * ) Notice: Subject to any disclaimer, the term of this patent is extended or adjusted under 35 U.S.C. 154(b) by 145 days.

(21) Appl. No.: 13/896,094

(22) Filed: May 16, 2013

(65) Prior Publication Data

US 2013/0307215 A1 Nov. 21, 2013

(30) Foreign Application Priority Data

May 17, 2012 (JP) ..... 2012-127495

(51) Int. Cl.
*A63F 1/06* (2006.01)
*A63F 1/14* (2006.01)
(Continued)

(52) U.S. Cl.
CPC ..... *A63F 1/14* (2013.01); *G07F 17/3241* (2013.01); *A63F 2009/2422* (2013.01);
(Continued)

(58) Field of Classification Search
CPC ..... G07F 17/3241; A63F 2250/58; A63F 2009/242; A63F 2009/2422; A63F 2009/2425
USPC ..... 273/148 R, 292, 293; 463/29
See application file for complete search history.

(56) References Cited

U.S. PATENT DOCUMENTS 6,010,131 A 1/2000 Myers
6,250,632 B1 6/2001 Albrecht
(Continued)

FOREIGN PATENT DOCUMENTS

CN 1498126 5/2004
CN 101172273 5/2008
(Continued)

OTHER PUBLICATIONS

Macao Patent Application No. I/001207, Office Action mailed Apr. 4, 2014.
(Continued)

*Primary Examiner* — Benjamin Layno
(74) *Attorney, Agent, or Firm* — Sheppard, Mullin, Richter & Hampton LLP

(57) ABSTRACT

A card disposal system for a table game is provided that is capable of assuring the disposal of all of cards corresponding to a predetermined number of decks that are used at a game table without any deficiency and without any fraudulent diversion being made over such cards.

A card disposal system for a table game of the present invention includes a discharge opening (4) for disposal of cards (3) after a game, a disposed card receiving board (5) for receiving the cards 3 from the discharge opening (4), a disposed card information acquiring means (6) that acquires information on the number (rank) of the card 3 placed in the discharge opening (4), a group information acquiring means (7) that acquires group information of the card (3) disposed of, a card counter (8) serving as a number counting means that counts the number of cards (3) that are placed in the discharge opening (4) for disposal, a deck examination means (13) that determines whether cards (**3*h*) to be disposed of includes all the cards within a predetermined number of decks, for example, 416 cards in case of 8 decks (52 cards×8 decks), and an output means (10**) that outputs a result of the determination. With the card disposal system, a void hole is made on the card to be disposed of, and the disposal of all the cards without any deficiency and without any fraudulent diversion being made over such cards is assured.

16 Claims, 14 Drawing Sheets

(51) Int. Cl.

| | |
|---|---|
| *G07F 17/32* | (2006.01) |
| *A63F 9/24* | (2006.01) |
| *A63F 1/02* | (2006.01) |

(52) U.S. Cl.

CPC ..... *A63F 2009/2425* (2013.01); *A63F 1/06* (2013.01); *A63F 2001/025* (2013.01); *A63F 2009/242* (2013.01); *A63F 2250/58* (2013.01)

(56) References Cited

U.S. PATENT DOCUMENTS

| | | | | |
|---|---|---|---|---|
| 6,726,205 | B1 * | 4/2004 | Purton | 273/148 R |
| 8,074,987 | B2 | 12/2011 | Soltys | |
| 2002/0017481 | A1 * | 2/2002 | Johnson et al. | 209/547 |
| 2004/0026636 | A1 | 2/2004 | Shigeta | |
| 2005/0104290 | A1 | 5/2005 | Grauzer et al. | |
| 2005/0113166 | A1 * | 5/2005 | Grauzer et al. | 463/29 |
| 2006/0247036 | A1 | 11/2006 | Shigeta | |
| 2008/0001356 | A1 * | 1/2008 | Franks | 273/148 R |
| 2013/0307215 | A1 | 11/2013 | Shigeta | |

FOREIGN PATENT DOCUMENTS

| | | | |
|---|---|---|---|
| CN | 103418128 | | 12/2013 |
| EP | 1316341 | A1 | 4/2003 |
| EP | 1872872 | A2 | 2/2008 |
| JP | 2004215806 | A | 8/2004 |

OTHER PUBLICATIONS

International Search Report, dated Jul. 25, 2013 for PCT/JP2013/003146.

* cited by examiner

| Combination | Arrangement of marking | Outputs of sensors |
|---|---|---|
| 1 | Blank<br>Blank | 21 OFF<br>21 OFF |
| 2 | Blank<br>M | 21 OFF<br>21 ON OFF |
| 3 | M<br>Blank | 21 ON OFF<br>21 OFF |
| 4 | M<br>M | 21 ON OFF<br>21 ON OFF |

FIG.4

CARD DISPOSAL SYSTEM FOR TABLE GAME

TECHNICAL FIELD

The present invention relates to a card disposition system for a table game that is able to prevent cards used in a card game from being fraudulently brought out, and has a function of detecting whether or not a predetermined number of cards are sufficiently disposed of.

BACKGROUND ART

A fraud at the game table is conceivable where a player replaces a card with another card during a game to provide an advantageous game condition for him/her. An example of apparatuses for preventing such a fraud is disclosed in US 2006-0247036A1. In this patent literature, it is determinable whether the cards appeared in the table game are the same as those used in the determination of the winners/losers of each of the game, thereby preventing any fraudulent actions in card games. The apparatus proposed therein prevents fraud by detecting whether or not a card dealt on the game table has been replaced with a false card and was used in determining the winners/losers of the game (see Patent Literature 1).

In order to replace any card during a game, it is necessary to obtain cards of the same type as those used in the relevant casino in advance. In many cases, cards used in a table game are collected at the end thereof, but those collected cards are combined into another card set for reuse. Thus, there is a risk that someone may obtain such cards for the purpose of committing fraud during the course of such re-combination of card sets.

CITATION LIST

Patent Literature

[PTL 1] US 2006-0247036A1

SUMMARY OF INVENTION

Technical Problem

With conventional apparatuses, it is not possible to dispose of all of cards, without any omission, that were used on the game table while concurrently confirming that there are a predetermined number of cards (for example, in the case where eight decks of cards are used, there should be 416 cards (52 cards×8 decks)). Also, generally at the game table, after the cut card is drawn, the set of cards that has been used in that game will no longer be used. However, unless the unused cards of that card set are sufficiently disposed of such cards may again be fraudulently brought out.

The present invention has been made in view of the above problem, and aims to provide a card disposal system that enables a perfect disposal operation in which disposal of cards that are to be discarded after the use thereof on the game table is performed only after confirming that the predetermined number of cards are all there (for example, in the case where eight decks of cards are used, there should be 416 cards (52 cards×8 sets)). Also, the system is capable of making a void hole or a notch on the cards after verifying the number of cards to make it impossible to reuse such cards, thereby completely preventing any fraudulent reuse of such cards.

Solution to Problem

To solve the above conventional problems, the present invention provides a card disposal system for disposing of cards that are housed in a card dealing apparatus (dealing shoe) placed on a game table and manually dealt onto the game table after the use thereof in a game, the card disposal system including: a set of cards made up of a plurality of decks of cards that can be housed in the dealing shoe; and a card disposal apparatus for disposing the cards collected, wherein a cut card for stopping a game is included in the set of cards, the card disposal apparatus includes:

a discharge opening for receiving a card to be disposed of;

a number counter for counting and storing the number of cards received from the discharge opening;

a voiding means for making a void hole or a notch on a card placed in the discharge opening;

a disposed card stocker for receiving a card that has passed through the voiding means in a disposed card carton; and a deck examination means for determining whether the number of cards placed in the discharged opening matches the number of cards corresponding to a predetermined number of decks, the discharge opening sequentially receives the cards that are used in each game and thereafter get collected therein, and is configured to be capable of receiving all cards left unused in the dealing shoe when the game is stopped at a predetermined time after the cut card is drawn from the dealing shoe, the deck examination means adds the number of cards used in each game, that number being counted by the number counter, and the number of the cards left unused in the dealing shoe at the predetermined time after the cut card is drawn from the dealing shoe, and determines whether the number of the cards disposed of matches the number of cards corresponding to a predetermined number of decks, and the disposed card stocker has a closed passage for disposed cards with which no card can be removed after it is placed in the discharge opening before it reaches the disposed card carton.

In addition, with the card disposal system for a table game of the present invention that solves the conventional problems, the disposed card carton of the disposed card stocker is configured to be capable of housing a scrap generated from making the void hole together with the card to be disposed of in the disposed card stocker.

Advantageous Effects of Invention

With the card disposal system for a table game of the present invention, it is possible to detect the incorporation of any false cards, and furthermore, to examine whether with respect to the cards that have been put inside a discharge opening, there are a predetermined number of genuine cards for each number (rank), thereby confirming that the cards used in a table game on the game table are a complete set of genuine cards that include the predetermined number of cards for each number (rank).

BRIEF DESCRIPTION OF DRAWINGS

FIG. 4 is a diagram showing the relation between the codes formed with a mark/marks M printed as information on a card, and the output waves from two UV sensors of a card information acquiring sensor.

DESCRIPTION OF EMBODIMENTS

Embodiment 1

Figure 1:
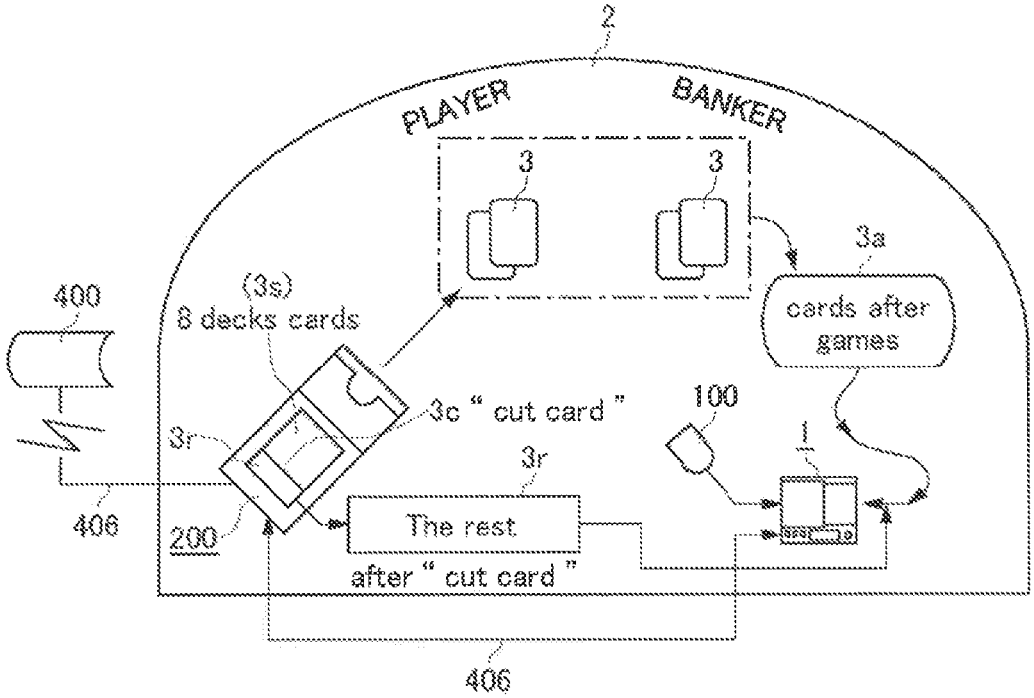
FIG. 1 is a plan view of a table game system according to an embodiment of the present invention.

Embodiment 1 of the present invention will be described with reference to the attached drawings. In FIG. 1, a card disposal apparatus 1 of a card disposal system for the table game according to Embodiment 1 of the present invention is installed on a game table 2. The game table 2 shown in FIG. 1 is depicted in a simplified manner and appears as it is used in a normal baccarat game. As is well known, there is a player and a banker in a baccarat game. In Embodiment 1, both the player and the banker are referred to as "player". A dealing shoe 200 is provided on the game table 2. The dealing shoe 200 is the source for the supply of cards 3, and the cards 3 drawn from the dealing shoe 200 are dealt to the players. When the game ends, the cards 3 are disposed of through the card disposal apparatus 1. The card disposal system of Embodiment 1 disposes of the cards 3 after their use in the game, the cards 3 being housed in the dealing shoe 200 that is placed on the game table 2 and manually distributed by the dealer or the like onto the game table 2. The card disposal system is basically configured with a set of cards 3 including a plurality of decks (normally, 6, 8 or 12 decks) of cards that can be housed in the dealing shoe 200, and the card disposal apparatus 1 that disposes of collected cards 3*a*.

Figure 12:
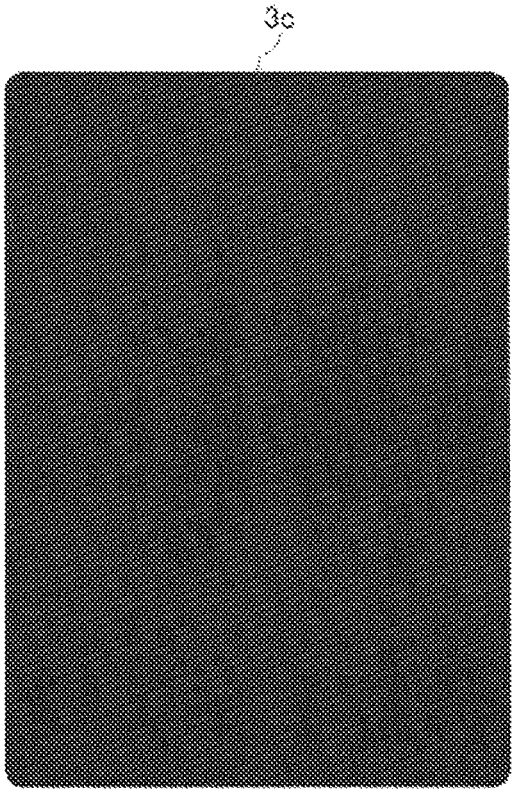
FIG. 12 is a plan view of a cut card of the embodiments of the present invention.
Figure 13:
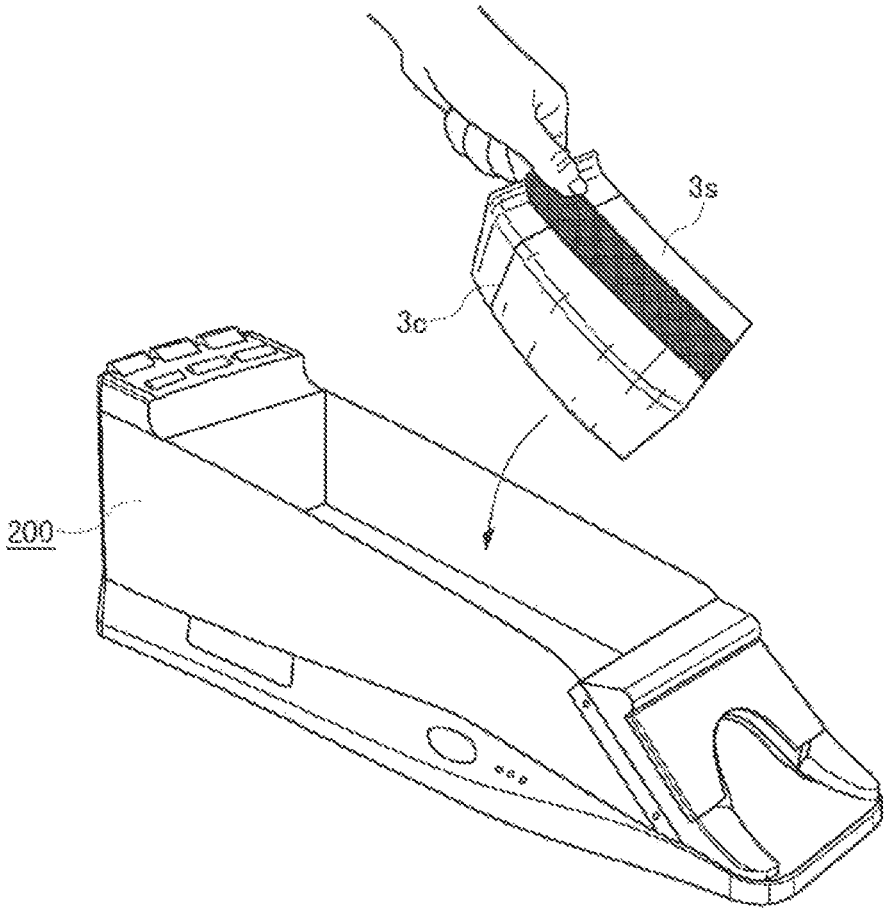
FIG. 13 is a perspective view illustrating the cards being housed in the dealing shoe.

A cut card 3*c* is inserted in a set 3*s* of cards 3 (a card set 3*s*) before the card set 3*s* is set in the dealing shoe 200 on the game table 2. The cut card 3*c* is inserted at any place within the latter half portion of the card set 3*s* when used in a game (in the last quarter or one-fifth of the card set 3*s*). The cut card 3*c* is used to end a game at the game table 2 leaving about 20 to 40 cards 3 in the dealing shoe 200, so as to prevent any player from counting the ranks of the cards dealt during a game to predict the ranks of the cards when the number of the cards that have not been dealt yet becomes small. The plan view of the cut card 3*c* is shown in FIG. 12.

The card disposal apparatus 1 is configured such that it sequentially receives the cards 3*a* used and collected in each game, and can receive all of cards 3*r* that are left unused in the dealing shoe 200 when the game is stopped at a predetermined time after the cut card 3*c* comes out of the dealing shoe 200 (at the next game, or a few games after the drawing of the cut card 3*c*). With a deck examination means to be described below, the card disposal device 1 adds the number of cards 3*a* that were used in each game, and the number of the cards 3*r* that are left unused in the dealing shoe 200 at a predetermined time after the drawing of the cut card 3*c* from the dealing shoe 200, and determines whether the total number of the disposed cards matches the number of cards corresponding to the predetermined number of decks.

Figure 2:
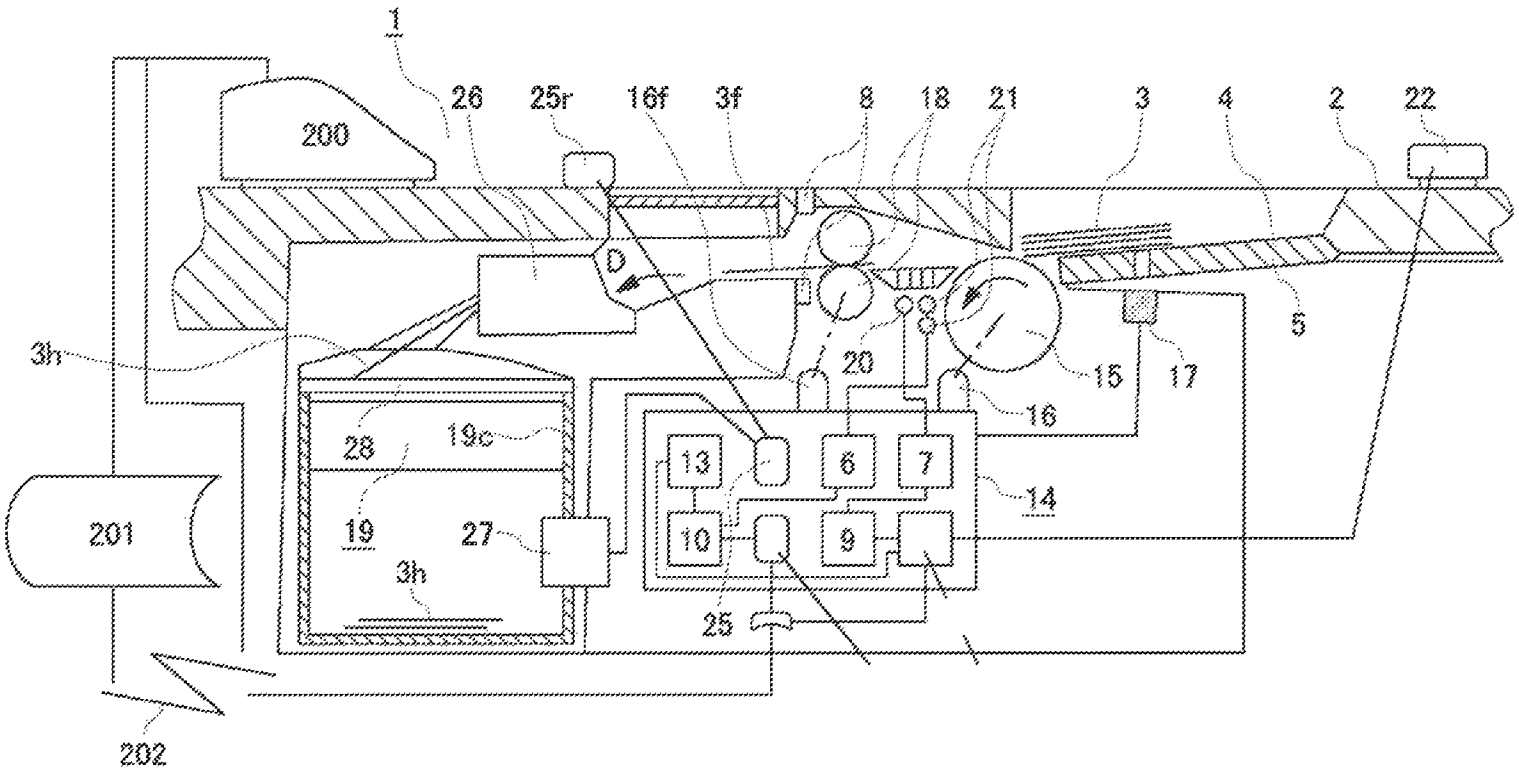
FIG. 2 is a cross-sectional view of a card disposal apparatus according to Embodiment 1 of the present invention as viewed from the side.

Next, the card disposal apparatus 1 will be described in detail with reference to FIG. 2 and the other drawings. The card disposal apparatus 1 includes a discharge opening 4 for the disposal after the game of the cards 3*a* that are dealt onto the game table 2 for each game. The card disposal apparatus 1 includes a disposed card receiving board 5 for receiving the cards 3*a* to be disposed of from the discharge opening 4, a disposed card information acquiring means 6 that obtains information on the number (rank) and the type (suit) of each card 3*a* placed in the discharge opening 4, a group information acquiring means 7 that acquires the group information of each card 3*a* to be disposed of, a card counter 8 serving as a number counting means that counts the number of the cards 3*a* that are placed in the discharge opening 4 for disposal, an authenticity determination means 9 that compares the group information of the cards acquired through the group information acquiring means 7 with predetermined group information, thereby determining whether the group information of the cards matches the predetermined group information, and an output means 10 that outputs the result of the determination made by the authenticity determination means 9.

The card disposal device 1 also includes a deck examination means 13 that counts the number of cards 3 at least for each number (rank) by integrating the information acquired from the disposed card information acquiring means 6 and the information of the card counter 8, thereby determining whether the number of the cards 3 put in the discharge opening 4 matches the predetermined number. The card disposal device 1 includes a control device 14 that performs an overall control of the card disposal device 1. Each means described above is arranged in the control device 14, which controls the operations thereof. The control device 14 is configured with an electronic circuitry that includes a microcomputer, memory and the like, and has the configuration of a general computer, such as a CPU, ROM, RAM or the like. The control device 14 performs the overall control of the card disposal device 1 by executing programs stored in the ROM or other memories, thereby performing the necessary processing.

A feed roller 15 for feeding the cards 3 to be disposed of one by one from the disposed card receiving board 5 is provided below the disposed card receiving board 5. The feed roller 15 is rotatively driven by a drive motor 16. The drive motor 16 is a stepping motor. When a card 3 is placed on the disposed card receiving board 5, a card sensor 17 detects the card 3. Then, the control device 14 controls the drive motor 16 to rotate the feed roller 15. In this manner, the feed roller 15 feeds the card 3 on the disposed card receiving board 5. The card 3 being fed by the feed roller 15 is moved forward in the direction of a disposed card stocker 19 (the arrow D) by a pair of forwarding rollers 18. The movement of the forwarding rollers 18 is controlled by a feed motor 16*f*. The moving speed of the forwarding rollers 18 is set such that the card 3 is forwarded in a speed faster than the speed in which the feed roller 15 feeds the card 3, and thus the card 3 is drawn by the forwarding rollers 18 and forwarded toward the disposed card stocker 19 (the arrow D) for certain. The information on the forwarded card 3 is detected and acquired by a group information acquiring sensor 20 and by two card information acquiring sensors 21.

The group information acquiring sensor 20 is connected to the group information acquiring means 7 that acquires the group information from the card 3. Also, the card information acquiring sensors 21 are connected to the disposed card information acquiring means 6 that acquires the information of the number (rank) of the card 3, thereby acquiring the number (rank) information. Each card 3 that is forwarded to the disposed card stocker 19 is detected by the card counter 8, and the number of cards 3 that passes through is counted. The signal of the group information acquiring sensor 20 is transmitted to the group information acquiring means 7. The authenticity determination means 9 compares the group information of the card 3 acquired by the group information acquiring means 7 with predetermined group information stored in advance, thereby determining whether the group information of the card 3 matches the predetermined group information. If the authenticity determination means 9 determines that the group information of the card 3 does not match the predetermined group information, that card 3 is determined to be a false card, and the control device 14 lights a display lamp/display lamps 22 through the output means 10 that outputs the determination results, and transmits the presence of any false card to a management division or the like of a casino or the like.

When any card 3 is determined to be a false card by the authenticity determination means 9, the control device 14 transmits such information to a voiding means (to be described later). The card 3 whose determination has been made by the authenticity determination means 9 is forwarded to the disposed card stocker 19. The card disposal device 1 has a closed passage for disposed cards with which no card 3 can be removed before it reaches a disposed card carton 19*c* of the disposed card stocker 19.

The information on the card 3 is acquired by the card information acquiring sensors 21 and the group information acquiring sensor 20 while it is forwarded to the disposed card stocker 19. After the card 3 is determined to be a genuine card, a void hole H is made by a voiding means 26 such that the card 3 cannot be used anymore. For this purpose, each card 3 forwarded to the disposed card stocker 19 passes through the void means 26. The void means 26 makes a void hole H on the card 3 with a hole-making means (such as a punch and a die, which are not shown in the drawings but will be described later). A card 3*h* with a void hole H then falls inside the disposed card carton 19*c* of the disposed card stocker 19, and is received by the disposed card carton 19*c* made of paper or plastic that is provided in the disposed card stocker 19. In Embodiment 1, the void hole H is created by the void means 26, but a configuration is also possible in which a notch C is formed on a corner of the card 3. In this manner, a void hole or notch is made on the card such that it cannot be reused after the disposal process and the checking of the number of the cards, thereby completely preventing the fraudulent reuse thereof. Note that a disposed card lock means 27 is provided in the disposed card carton 19*c* to prevent the fraudulent removal of any card 3, and a fraud preventing device 25 of the control device 14 controls the disposed card lock means 27 such that only authorized operators can remove the disposed card carton 19 with a key or the like.

The disposed card carton 19*c* is removed frontward in the direction perpendicular to the drawing in FIG. 1. After a card 3 enters the voiding means 26, it is impossible to access the card 3 from the outside until the card 3 reaches the disposed card carton 19*c*, and thus no card 3 may be fraudulently taken out. The disposed card carton 19*c* is made of paper or resin, and may be sealed by a sealing device 28 (by means of thermal bonding, lock stitch or the like) before removal. As described above, although only supervisors in a casino or the like can remove the disposed card carton 19*c*, with a key operation or the like, the disposed card carton 19*c* is sealed and thus it is impossible to remove or directly touch the cards 3*h* to be disposed of ("disposed cards 3*h*").

The disposed card carton 19*c* of the disposed card stocker 19 can be attached/detached to/from the disposed card stocker 19, and is made of paper or a plastic material so as to be capable of being disposed of or shredded by a shredder or the like while containing the disposed cards 3*h* inside. Therefore, it is possible to dispose of the disposed card carton 19*c* with the disposed cards 3*h*, which makes the disposal operation simple and economic.

The deck examination means 13 will be described next. Generally, a plurality of decks (4, 6, or 8 decks) of cards are set in the dealing shoe 200 (electronic shoe) that is placed on the game table 2. Although the cards inside the dealing shoe 200 are dealt in each game, all the cards are never used up. The cut card (not shown) or the like is inserted in the plurality of decks (4, 6, or 8 decks) of cards in the dealing shoe 200 for security purposes, and when the cut card is drawn, the cards inside the dealing shoe 200 will no longer be used. All of remaining cards 3*r* are placed in the discharge opening 4 for disposal.

The information on the number (rank) is acquired from these remaining cards 3*r* by the disposed card information acquiring means 6. The deck examination means 13 combines the information of the number (rank) acquired through the disposed card information acquiring means 6 from the remaining cards 3*r* with the already-acquired information of at least the number (rank) of the cards 3*a* used in the games. Then, the resulting information and the information from the card counter 8, which serves as the number counting means, are used in an integrated manner so as to obtain the number of cards for each number (rank) of the cards. Thereafter, with respect to all the cards 3 that are placed on the game table and then placed in the discharge opening 4, it is determined whether, for each number (rank), the number of cards matches the number corresponding to a predetermined number of decks (whether there are 32 cards (4 suits×8 decks) for each number, from Ace to King).

The total number of the cards 3 used in a table game is determined in advance in a casino or the like (normally, 4, 6, 8, 10 or 12 decks). For example, in the case of 8 decks, of the 416 cards 3 (52 cards×8 decks), there are 8 cards that will have the same suit and rank. In the control device 14, the deck examination means 13 determines whether there are a predetermined number of cards 3 for all combinations of a certain rank and a certain suit. Then, through the output means 10 that outputs the results of determination, the display lamp/display lamps 22 is/are lighted in different colors depending on the results of the determination, and at the same time, the counting result of the number of cards 3 is transmitted to a general management division or the like 201 through a communication means 202.

When the cards 3 that were already disposed of in the disposed card stocker 19 and the cards 3 that were not used in the game but were collectively placed on the disposed card receiving board 5 of the discharge opening 4 (which are also to be forwarded to the disposed card stocker 19) are added, it is expected that the total number of the cards 3 will be 416, which corresponds to the number of cards 3 that were first set in the dealing shoe 200 (52 cards×8 decks). In the case of a card set that includes 8 decks of cards, the deck examination means 13 determines whether there are 32 cards for each of the 13 ranks (in total, 416 cards) based on the information obtained from all of the 416 cards (52 cards×8 decks).

Next, the cards 3 used in the card disposal system for the table game according to the embodiments of the present invention will be described. For each card 3, a code 102 by which the number of the card 3 is encoded and which is composed of marks M that are invisible under normal conditions is placed on the upper side and the lower side of the card 3 in a point-symmetric manner. The code 102 is configured by a combination of the number and the arrangement of the plurality of marks M printed in infrared or ultraviolet reactive ink or the like that are invisible in daylight. Also, the card 3 includes a group code information 103 that is used as an authenticity determination code, and the group code information 103 is created by coding information that indicates the authenticity of the card, and arranging the coded information by printing or the like so as to be invisible under normal conditions (for example, in ultraviolet reactive ink). The code 102 and the group code information 103 are arranged in at least two positions on the card 3 in a point-symmetric manner using the center of the card 3 as reference.

Figure 3:
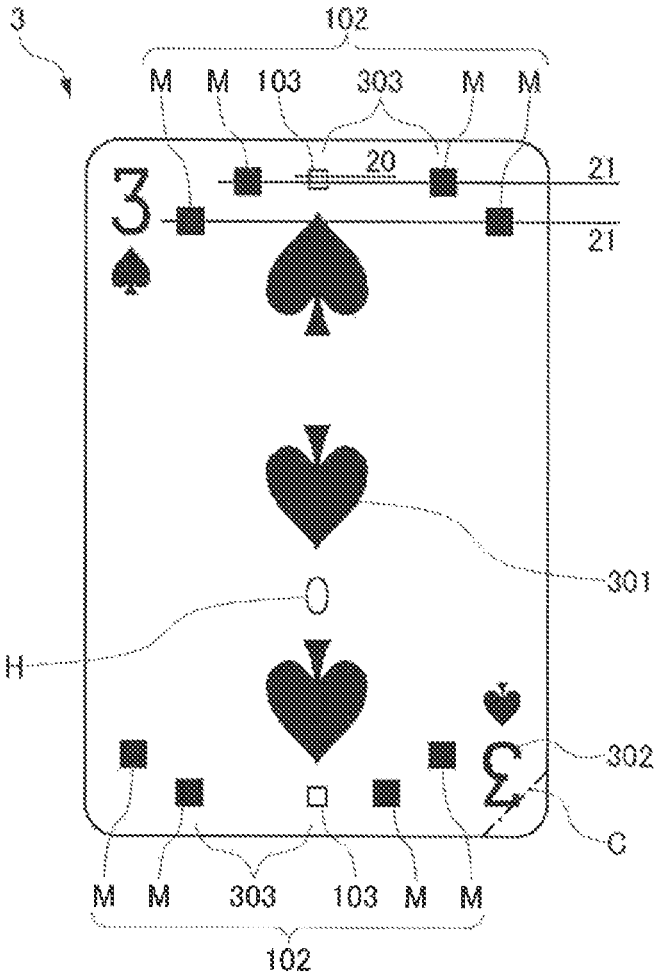
FIG. 3 is a plan view of a card according to Embodiment 1 of the present invention.

The code 102 is read by the two card information acquiring sensors 21 that configure the card information acquiring sensor 21. The card information acquiring sensor 21 is configured to produce an output signal upon detection of a Mark M (a known ultraviolet responsive optical sensor or the like is used). The relation between the marks M and the output of the on signals from the two UV sensors (the output of electrical signals produced when the code 102 configured by the marks M is read) are shown in FIG. 3. It is possible to identify a predetermined arrangement pattern of the marks M based on the comparison results of the relative changes in the output of the on signals from the UV sensors with respect to the code 102 configured by the marks M. As a result, in the example shown in FIG. 3, in two rows (the upper and lower rows), four types of arrangement patterns of the mark M are possible, and since patterns are printed in four columns, it is possible to form 256 types of codes (4×4×4×4). Fifty two (52) playing cards are each assigned one of the 256 codes, and the relations of such assignment are stored in a memory or by a program as an association table. A configuration is thereby adopted in which the disposed card information acquiring means 6 can, by identifying the code 102, identify at least the number (rank) of the card 3 based on that predetermined association table (not shown). Preferably, the code 102 is printed with a paint material that becomes visible when irradiated with a UV ray, and placed in a position where it does not overlap with the suit indications 301 of the card 3 or indexes 302. Also, a space 303 is provided between each of the code 102 and the group code information 103, and the edge of the card 3. Also, the group code information 103 may be printed in the same position with an ink to represent the group code information in the code 102.

Next, the authenticity determination means 9 will be described, the authenticity determination means 9 determining the authenticity of a card 3 based on the information relating to its authenticity. As described above, a card 3 whose authenticity is to be examined includes a group code information 103 serving as the group information; the group code information 103 is created by encoding information that indicates the authenticity of the card 3, and is formed so as to be invisible under normal conditions (for example, in ultraviolet reactive ink). The group code information 103 is a substance or material (such as an ink or paint material) itself that emits, as a code, light rays of different wavelength spectra when irradiated with light rays of different wavelengths. The group information acquiring sensor 20 emits invisible light rays of different wave lengths onto the group code information 103, and receives light rays of at least two different wave lengths emitted by the group code information 103. Then, the authenticity determination means 9 has a function of determining whether the ratios of the intensities of these light rays are the same, thereby determining the authenticity of the card 3. A configuration is also possible in which light rays of different wavelength spectra are received and two or more light rays of more complex wavelengths are analyzed.

A polymer material, DNA material or the like that has a molecular structure with which a light ray of a specific wavelength is emitted against light is used as a substance or material that emits light rays of different wavelength spectra against invisible light rays of different wavelengths (ultraviolet ray, infrared ray, etc.); this serves as the group information. A polymer material that has a molecular structure with which a light ray of a specific wavelength against is emitted against light is printed in the upper and lower edges of the card 3 as shown in FIG. 2, as the group code information 103 serving as the group information. The group code information 103 cannot be recognized by human eyes under normal use conditions (daylight, natural light, or the like). The group code information 103 is read by the group information acquiring sensor 20. Also, the group information may be mixed with an infrared or ultraviolet responsive ink for printing the code 102, which is used for identifying the number (rank) of the card 3, as printed. Each group code information 103, which serves as the group information, within the infrared or ultraviolet responsive ink, cannot be recognized by human eyes under normal use conditions (daylight, natural light, or the like). The light source for reading the group code information 103 is integrally provided with the group information acquiring sensor 20. In Embodiment 1, LEDs that emit ultraviolet rays of two different wavelengths (UV LEDs) are used as the light source (not shown)

The group code information 103 that serves as the group information is printed independently and in the same position at least for each unit of a card deck, as described above. However, a configuration is also possible in which the group code information 103 is configured using a certain substance or material that serves as a code, and such a substance or material is contained in a coating material, anchor coating material, in the ink to print the back pattern, mark, index, or the code to indicate the number of the mark on the surface of the card. When the group code information 103 is read, the group information acquiring sensor 20 emits two types of ultraviolet rays, irradiates the group code information 103 printed on the card 3 with the rays, and receives the light rays of different wavelength spectra emitted by the group code information 103. The control device 14 including the authenticity determination means 9 is configured with an electronic circuitry that includes a microcomputer, memory and the like; has the configuration of a general computer, such as a CPU, ROM, RAM or the like; and performs the processing to determine the authenticity of the group code information 103.

Embodiment 2

Figure 5:
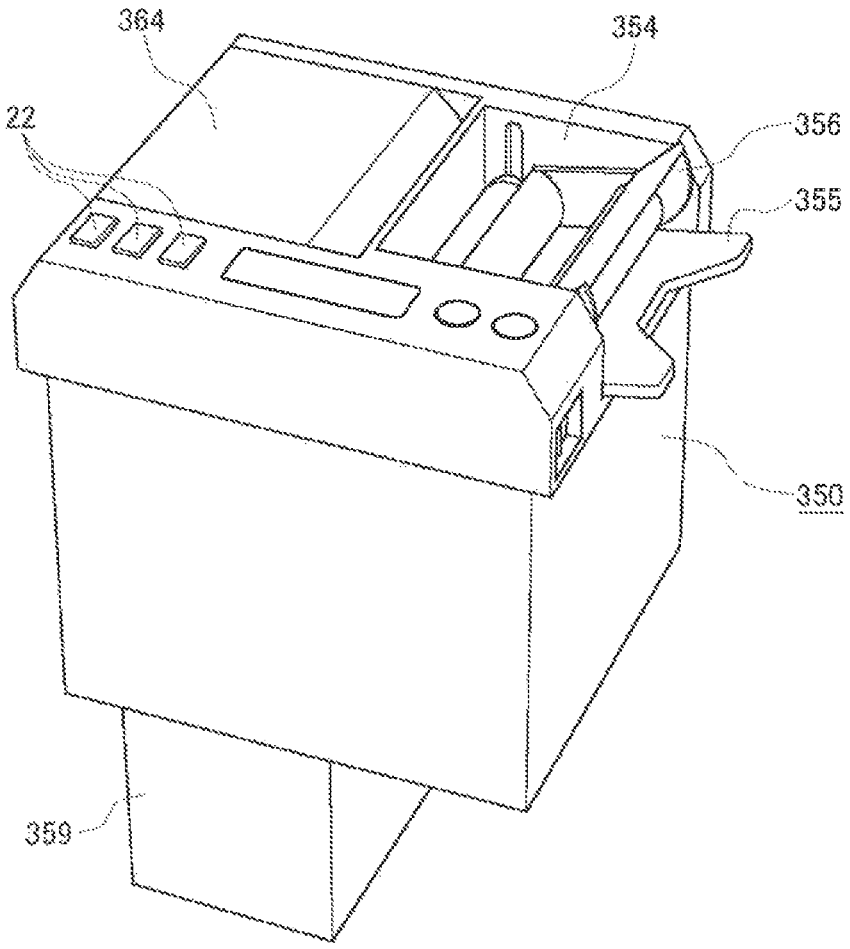
FIG. 5 is a perspective view of a card disposal apparatus of a table game system according to Embodiment 2 of the present invention.
Figure 6:
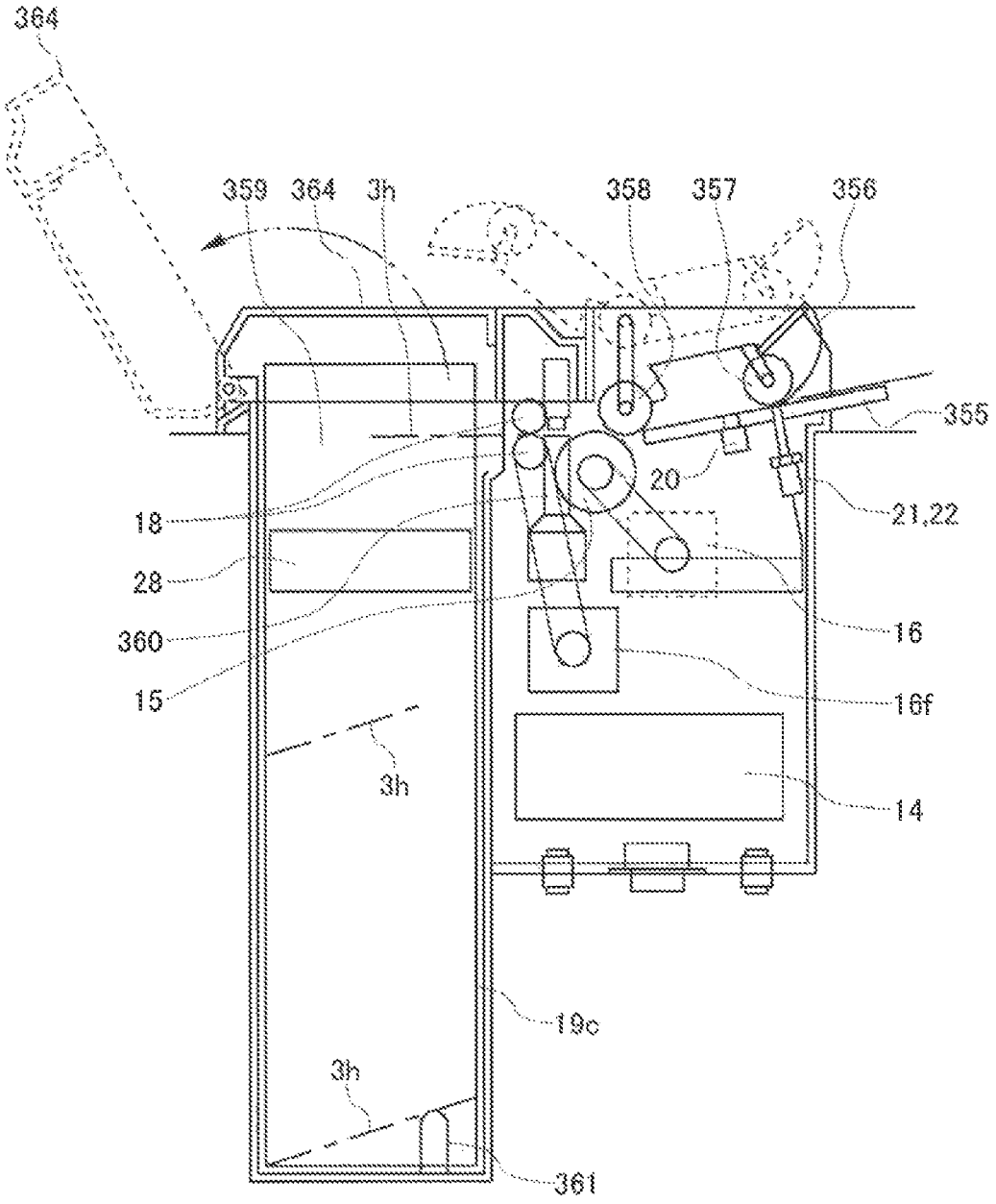
FIG. 6 is a cross-sectional view of the card disposal apparatus as viewed from the side.

Embodiment 2 of the table game system of the present invention will be described in detail below. In Embodiment 2, the same reference numerals are assigned to the same configurations and elements used in Embodiment 1, so the description thereof will be omitted. FIG. 5 shows an overall schematic diagram of the table game system of Embodiment 2. In FIG. 5, the game table 2 is depicted in a simplified manner, and appears as it is used in a normal baccarat game.

As is well known, there is a player and a banker in a baccarat game. In Embodiment 2, both of the player and the banker are referred to as "player." The dealing shoe 200 and a card disposal apparatus 350 are placed on the game table 2. The dealing shoe 200 is the source for the supply of cards 3, and cards 3 drawn from the card dealing shoe 200 are dealt to the players. When the game ends, the cards 3 are disposed of by the card disposal apparatus 350. The dealing shoe 200 has a function of reading the information of the number (rank) and the type (suit) of the cards 3 dealt onto the game table.

Figure 7:
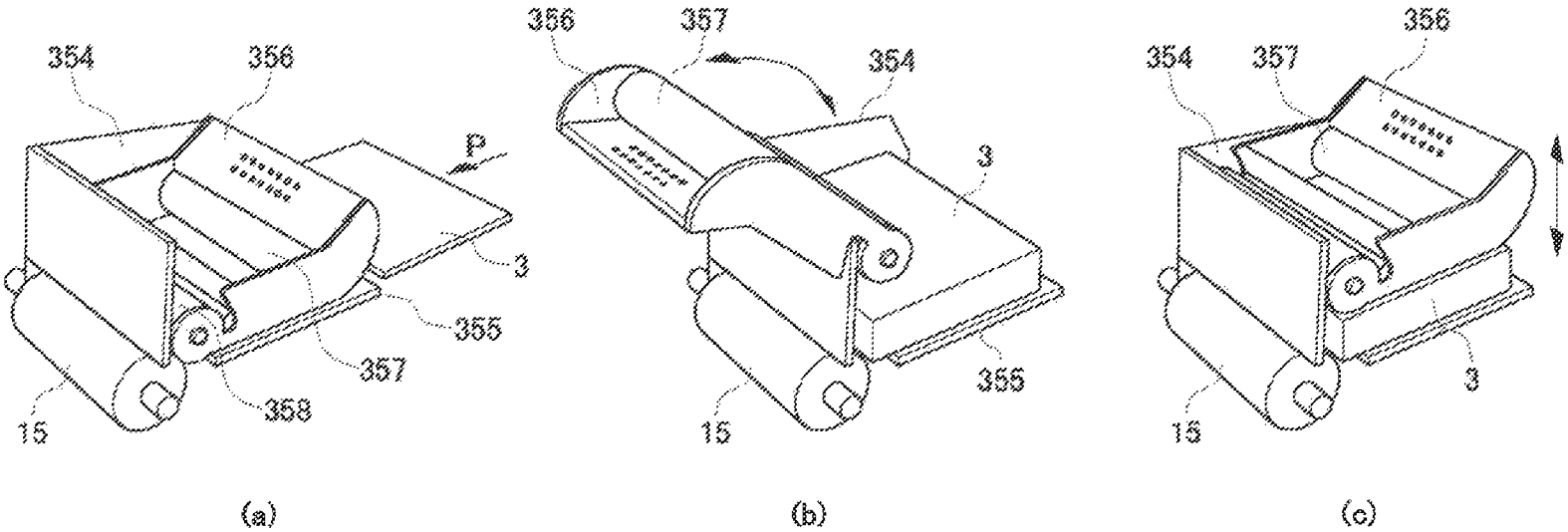
FIGS. 7(*a*), 7(*b*) and 7(*c*) are perspective views each illustrating the function of a weight of the card disposal apparatus.

Next, the card disposal apparatus 350 of Embodiment 2 will be described. The card disposal apparatus 350 of Embodiment 2 is placed on the game table 2 or on a side surface thereof. Cards 3 are disposed of through a disposal opening 354 after they are used in a game. A weight 356 is placed above a disposed card receiving board 355 for receiving cards 3 to be disposed of. The weight 356 is placed to assist the feeding roller 15 such that the feeding roller 15 can sufficiently feed a card 3 even if the card 3 to be disposed of has been bent or the like during the game; the front and rear portions of the card 3 are pressed downward by weight rollers 357 and 358. The weight 356 receives the card 3 from the direction indicated by the arrow P into the discharge opening 354, as shown in FIG. 7(*a*), and can also move upward so as to be capable of receiving even a bunch of cards 3 (FIGS. 7(*b*) and 7(*c*) each show this state).

The card 3 being fed by the feed roller 15 is moved forward by a pair of forwarding rollers 18 in the direction of a disposed card stocker 359. The card information acquiring sensors 21 for the disposed card information acquiring means 6, which acquire the information of the number (rank) from the card 3, are placed in the disposed card receiving board 355. The card information acquiring sensors 21 and the group information acquiring sensor 20 respectively acquire information from the card 3 before the card 3 is forwarded to the disposed card stocker 359.

As described above, once the cut card 3*c* is drawn, only a predetermined number of games are played thereafter, and then the cards 3*r* left unused at the end of such games are no longer used and removed from the dealing shoe 200. The remaining cards 3*r* are then placed in the discharge opening 354 at one time (as shown in FIGS. 7(*b*) and 7(*c*)). Based on the information acquired from the cards 3*h* that were used in the game and already disposed of in the waste stocker 359, and the information acquired from the cards 3 placed on the disposed card receiving board 355, the deck examination means 13 determines whether there are a predetermined number of cards 3 for each number (rank) with respect to all the cards 3 placed in the discharge opening 354.

A punching device 360 is provided between the feeding roller 15 and the forwarding rollers 18 as a voiding means for making a void hole H on the card 3. If a card 3 is determined to be a genuine card, a single void hole H is made on the card 3 (an example of which is shown in FIG. 2). If a card 3 is determined to be a false card, two void holes (the numbers of holes can be changed, for example three void holes) H are made on the card 3 (not shown). A variation is possible in which a void hole H having a different shape is made instead of two void holes H. A void hole or notch is created by the punching device 360, thereby completely preventing reuse of cards by making it impossible to reuse such cards after the disposition operation and verification of the number of cards.

The cards 3*h* that have had a void hole H made thereon fall inside the disposed card carton 19*c* of the disposed card stocker 359. The cards 3*h* that have had a void hole H made thereon by the punching device 360, which serves as a voiding means, are received by the disposed card carton 19*c* that is made of paper or plastic and provided in the disposed card stocker 359.

Figure 8:
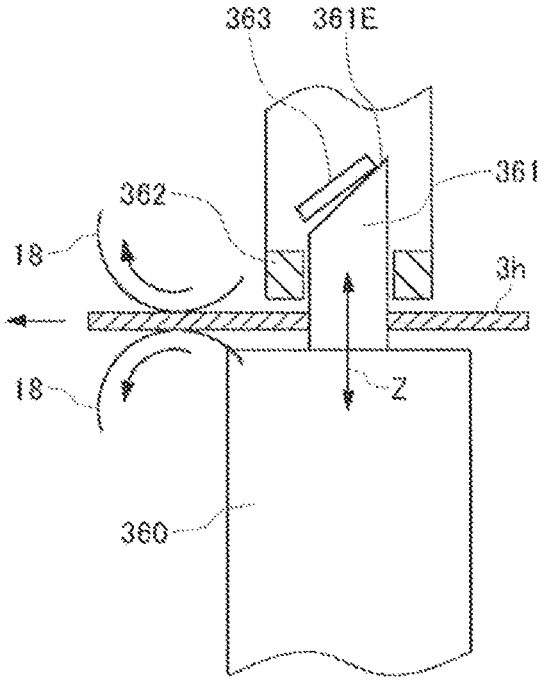
FIG. 8 is a cross-sectional view of a main portion of a punching device (voiding means) of the card disposal apparatus.
Figure 9:
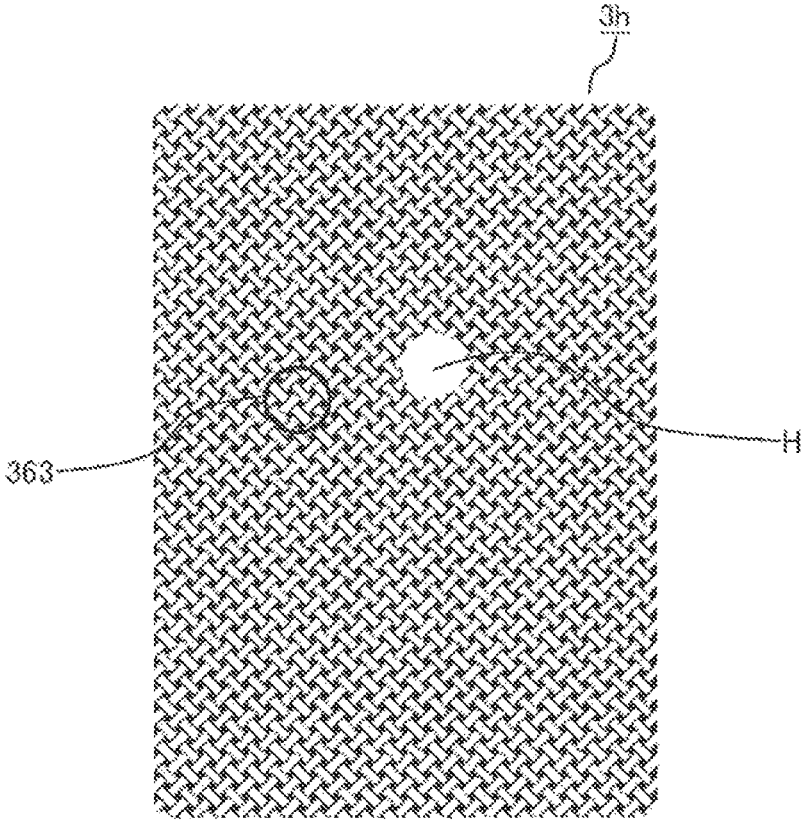
FIG. 9 is a plan view showing a card with a void hole made by the punching device.

Next, the punching device 360 will be described in detail with reference to FIG. 8. The punching device 360 is configured using a punch 361 and a die 362 that are placed in such a way that the card 3*h* to be disposed of can be placed between them. The punch 361 is driven in the direction of arrow Z toward the card 3*h* (by a mechanism such as a motor), thereby making a void hole Hon the card 3*h* at a place between the punch 361 and the fixed die 362. A slope portion 361E is formed at the upper end portion of the punch 361 such that a void scrap 363 generated when the void hole H is made falls on the card 3*h*. Due to this slope portion 361E at the upper end portion, the void scrap 363 falls on the card 3*h* (FIG. 9 shows such a state). Thereafter, the void scrap 363 and the card 3*h* fall inside the disposed card carton 19*c* with the void scrap 363 placed on the card 3*h*. If a fraud detection means 12 detects the incorporation of any false card, two void holes H are made on the relevant card 3*h*, and such false card 3*h* also falls inside the disposed card carton 19*c* with two void scraps 363. Since the void scrap 363 falls inside the disposed card carton 19*c* with the card 3*h*, it is not necessary to separately dispose of the void scraps 363, which enables its efficient disposal.

Figure 10:
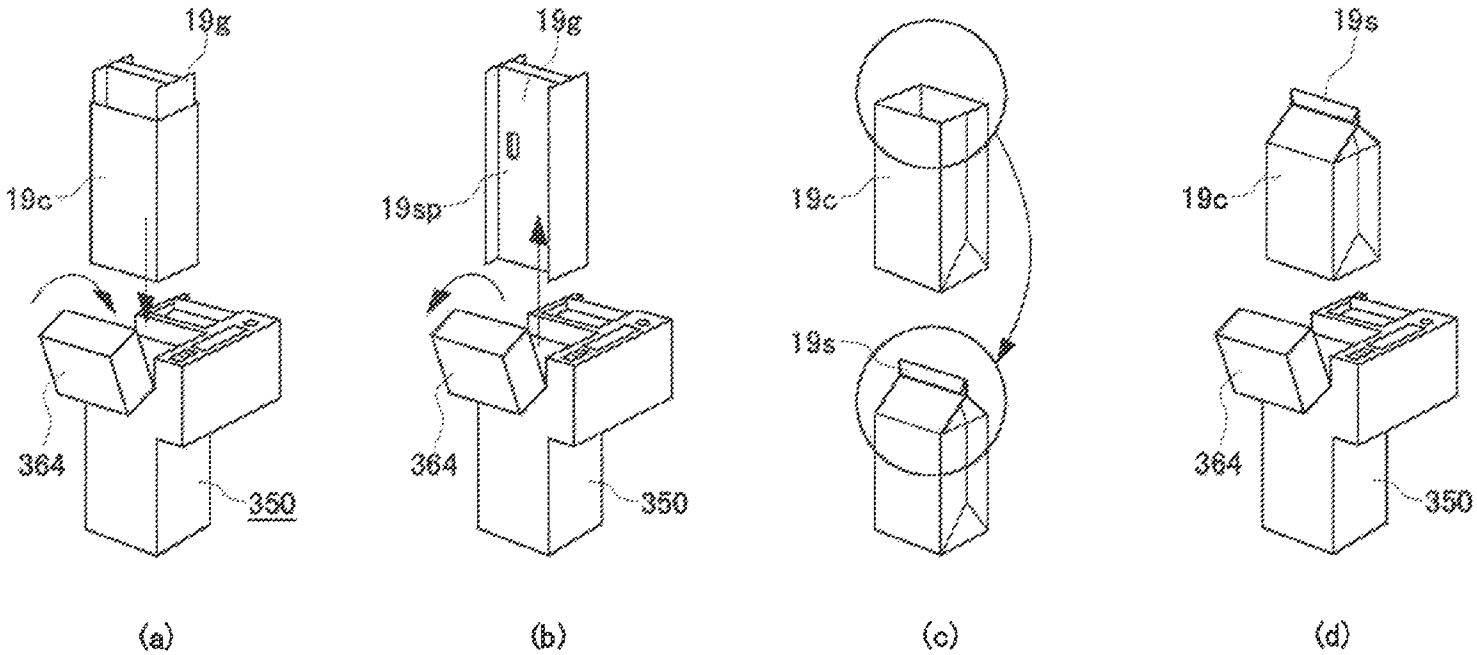
FIGS. 10(*a*), 10(*b*), 10(*c*) and 10(*d*) are perspective views of the card disposal apparatus each illustrating the procedure for attaching and removing a disposed card carton to and from a disposed card stocker of the card disposal apparatus.

The attachment and removal of the disposed card carton 19*c* to and from the card disposal apparatus 350 will be described below. The disposed card carton 19*c* is inserted to the card disposal apparatus 350 from the top as shown in FIG. 10(*a*). A guide 19*g* having a cross section similar to a reversed angular "C" is attached to the disposed card carton 19*c* in advance in order to stabilize its shape. The disposed card carton 19*c* in which the disposed cards 3*h* are housed is removed upward, and then, the guide 19*g* is removed first (see FIG. 10(*b*)). The disposed card carton 19*c* is made of resin or paper, and sealed with a sealing device 28 that performs the sealing through a known thermal bonding method or with an adhesive tape (by means of thermal bonding, lock stitch or the like) before it is removed for disposal (see FIG. 10 (*c*)). A lid 364 that only an authorized supervisor of a casino or the like can open with a key operation or the like is provided in the upper portion of the card disposal apparatus 350, and the disposed card carton 19*c*, which is closed by way of a sealing 19*s* so that no card 3*h* can be removed, is removed upward (see FIG. 10 (*d*)). The guide 19*g* has a package disposal space 19*sp*. After the cards 3*s* have been set to the dealing shoe 200, a package for the set of playing cards 3*s* can be disposed into the package disposal space 19*sp*.

Figure 11:
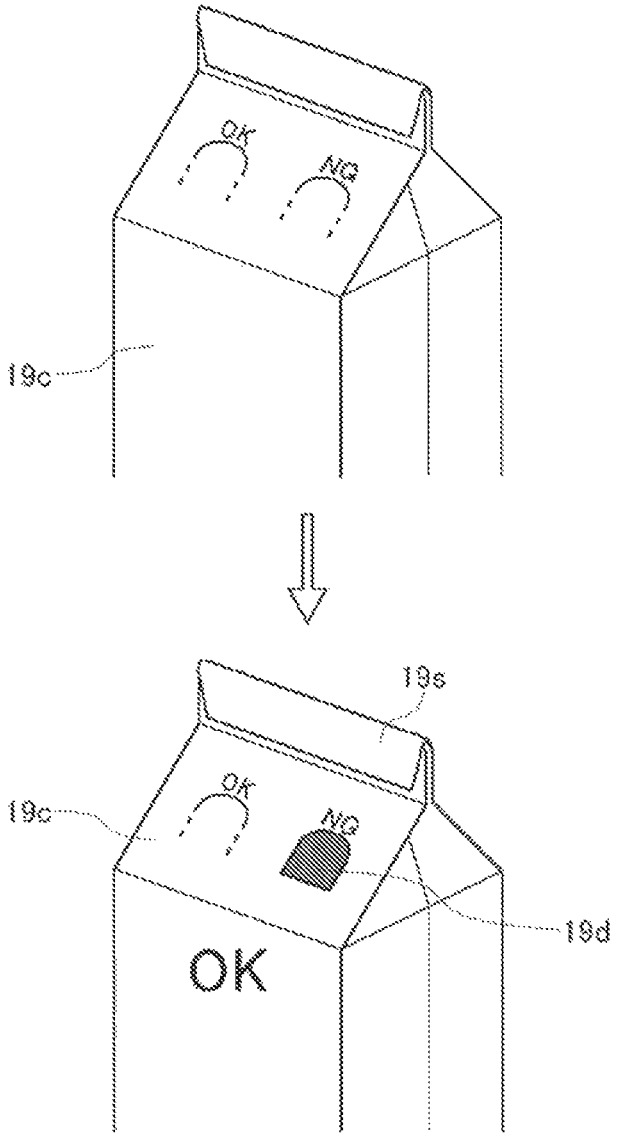
FIG. 11 is a perspective view of a main portion of a disposed card carton of the disposed card stocker according to another embodiment.

After the fraud detection means 12 has determined that the disposed card carton 19*c* of the disposed card stocker 19 is normal, and the deck examination means 13 has confirmed that the number of the cards matches the number of cards corresponding to a predetermined number of decks, an OK display (19*d*) as the result of the determination of the deck examination means 13 is exhibited, as shown in FIG. 11. This OK display may be exhibited by printing or stamping the letters "OK". A device for exhibiting such a display on the disposed card carton 19*c* may be added. If the fraud detection means 12 has detected the incorporation of any false card, two void holes H are (or a hole having a different shape is) punched on the relevant card 3, and an NG display is exhibited on the disposed card carton 19*c* of the disposed card stocker 359 as a result of the determination being "abnormal."

The above is a description of Embodiments 1 and 2 of the present invention. As a variation of the present embodiments, the group code may be printed on the card 3 in a similar manner to that of the mark M or the group code information

103. The group information, which indicates the group of the group code, may be different for each deck or for each plurality of decks of cards 3. The group information may be differentiated for each casino or table where the cards are used, or for any other unit. The group information may be different for each card supply source (card shoe or the like). In addition, a different group code may be set for each manufacturing lot, or each casino that uses the cards.

In the embodiments described above, a polymer material is printed on the genuine cards 3 as the group code information 103. However, in order to configure the authenticity determination code in a more complicated manner, a configuration may be adopted in which a card further includes a group code that contains the group information, which indicates the group of the card, and the authenticity determination code is printed within that group code. In this case, a configuration is possible in which such group code is read by a code reading unit that reads the code indicating the number of the card, or a configuration is also possible in which such group code is read by the group information acquiring sensor 20 of an authenticity determination unit from the authenticity determination code that indicates the authenticity of the card, and the group code is determined or distinguished by the authenticity determination unit.

It is also possible to configure the authenticity determination code in an additionally complicated manner through the improvement of the present embodiments by the following method: two or more substances such as polymer materials are selected, such selected substances whose reflected light rays have mutually different spectra are then used in combination, and the resultant complex is thereafter used as the authenticity determination code. Although an invisible ultraviolet responsive material and a UV sensor for detecting that material are used in the present embodiments, such invisible ultraviolet responsive material is an example of the group code information 103 that cannot be read by human eyes but may only be read under a prescribed condition. Accordingly, an infrared responsive material that is invisible to the human eye may be used instead. The group code information 103 of the playing cards may also include such information that is unique to the casino where the playing cards are used, or unique to each table in the casino or each seller of the playing cards.

Next, the card disposal system of further embodiment will be described with FIG. 14. In this further embodiment the set of cards 3*s* made up of a plurality of decks of cards is a shuffled playing cards shuffled to have a unique arrangement order and packaged in a package 404 and a uniquely identifiable shuffled card ID 403 being different each other attached to each shuffled playing cards as an ID code or RFID (IC tag); and the system has a barcode reader 100 or RFID (IC tag) reader (not shown) to reads the card ID 403 as ID code.

Figure 14:
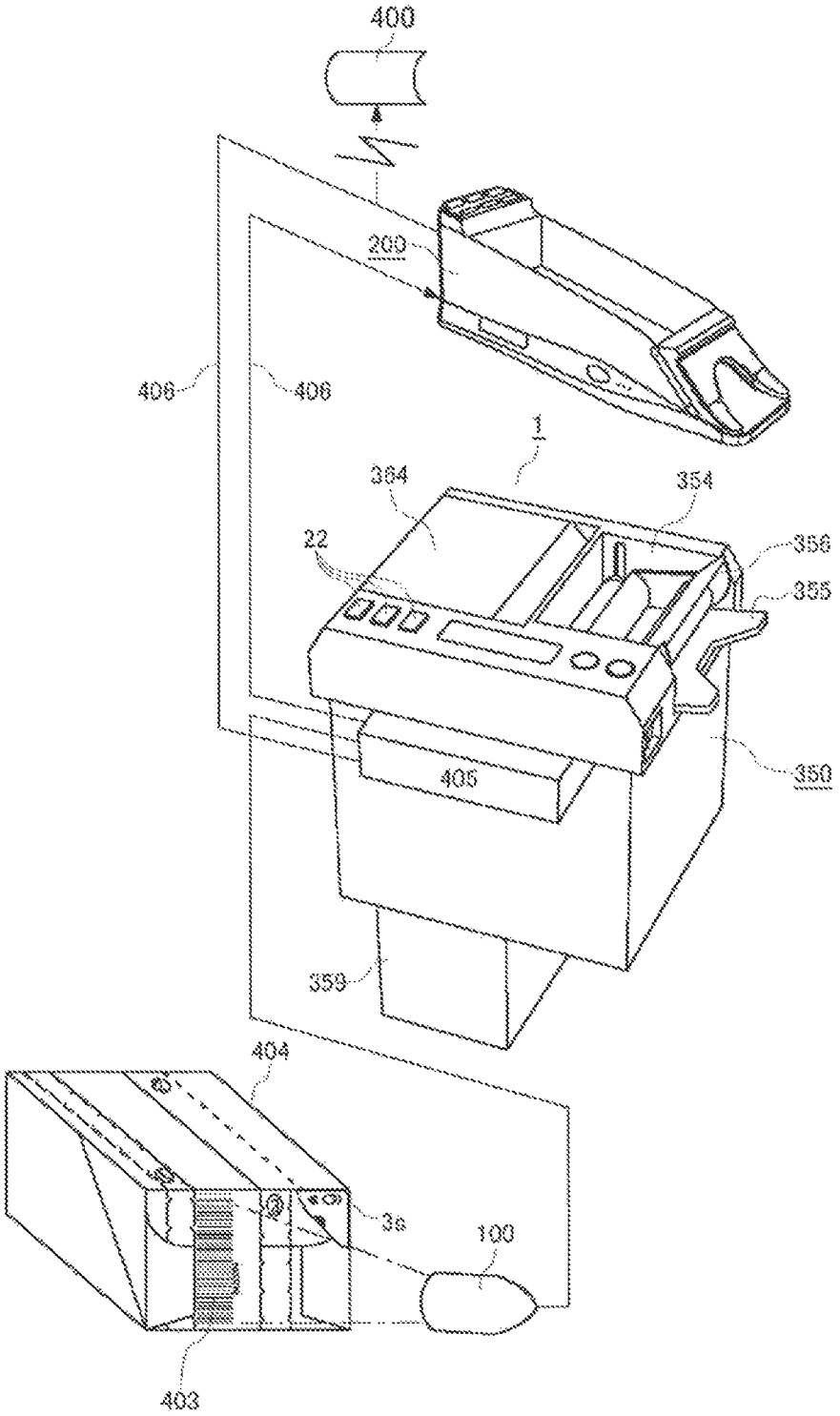
FIG. 14 is a perspective view illustrating the card disposal system of another embodiments of the present invention.

The card disposal apparatus 350 for disposing the cards in this further embodiment has the same configuration as the embodiment 2 and this has the same number in FIG. 14 but wherein the deck examination means 405 adds every numbers of cards which have the same rank received by the discharge opening 354 and examines whether or not each numbers of the cards which have the same rank match the numbers of the cards in every ranks sent by the dealing shoe 200 through a communication means 406 and outputs the result of the examination. (if there is a mismatch or not) together with the card ID 403 to the main frame of a central computer system 400 of casinos or administrative sections. The dealing shoe 200 sends the rank of a card every time when the dealing shoe 200 reads a card and sends the rank of a card and numbers of the cards being read by the dealing shoe 200 by communication means 406. The deck examination means 405 adds the numbers of cards, memorize the rank of the cards sent and display the number received by display (LED etc.). Also the deck examination means 405 adds every numbers of cards which have the same rank each received by the discharge opening 354. The deck examination means 405 counts down the numbers displayed when it receives the cards by the discharge opening 354.

When the dealing shoe 200 reads the cut card 3*c* the dealer at the game table stops using the set of cards 3*s* in the dealing shoe 200. At this timing the deck examination means 405 examines whether or not each numbers of the cards which have the same rank match the numbers of the cards in every ranks sent by the dealing shoe 200 through a communication means 406 with every numbers of cards which have the same rank each received by the discharge opening 354 and outputs the result of the examination. (if there is a mismatch or not) together with the card ID 403 to the main frame of a central computer system 400 through communication means 406 or through the dealing shoe 200) to casinos or administrative sections.

When the timing comes that they have to change whole set of cards in the dealing shoe 200 after cut card has drown to the table and all the cards of the set of cards 3*s* received by the discharge opening 354, the deck examination means 405 examines whether or not each numbers of the cards in every ranks received by the discharge opening 354 have the same ranks with predetermined numbers for predetermined decks sets (8 decks etc.) and outputs the result of the examination together with the card ID 403 to the main frame of a central computer system 400 through communication means 406 or through the dealing shoe 200) to casinos or administrative sections.

In the embodiments there is 256 types of codes (4×4×4×4). Fifty two (52, 13 ranks×4 suits) playing cards are each assigned one of the 256 codes, and the relations of such assignment are stored in a memory or by a program as an association table. As to the code 102, identify at least the number (rank) of the card 3 based on that predetermined association table (not shown) and the relation between each association table or database is recorded in association with the shuffled card ID (403) and one of the plurality of association tables or databases is identified by identifying the shuffled card ID 403 with the barcode reader or RF ID reader and based on the association table or database identified, the dealing shoe 200 and the card disposal apparatus 350 read the code 201 from each card and the rank of the card is identified based on that code 102.

The above is a description of the embodiments of the present invention. Of course, various modifications, additions and alterations may be made to the embodiments described above by those skilled in the art within the scope of the present invention. For example, any fraud in games other than baccarat may be detected with the present invention. The apparatus of the present embodiments may be modified as appropriate depending on the requirements of the game to which the apparatus is to be applied.

The invention claimed is:

1. A card disposal system for disposing of cards that are housed in a card dealing apparatus (dealing shoe) placed on a game table and manually dealt onto the game table after the use thereof in a game, the card disposal system comprising:

a set of cards made up of a plurality of decks of cards that can be housed in the dealing shoe; and a card disposal apparatus for disposing the cards collected, wherein a cut card for stopping a game is included in the set of cards, the card disposal apparatus includes:

a discharge opening for receiving a card to be disposed of;

a number counter for counting and storing the number of cards received from the discharge opening;

a voiding means for making a void hole or a notch on a card placed in the discharge opening;

a disposed card stocker for receiving a card that has passed through the voiding means in a disposed card carton; and a deck examination means for determining whether the number of cards placed in the discharged opening matches the number of cards corresponding to a predetermined number of decks, the discharge opening sequentially receives the cards that are used in each game and thereafter get collected therein, and is configured to be capable of receiving all cards left unused in the dealing shoe when the game is stopped at a predetermined time after the cut card is drawn from the dealing shoe, and the deck examination means adds the number of cards used in each game, that number being counted by the number counter, and the number of the cards left unused in the dealing shoe at the predetermined time after the cut card is drawn from the dealing shoe, and determines whether the number of the cards disposed of matches the number of cards corresponding to a predetermined number of decks.

2. The card disposal system according to claim 1, wherein the disposed card carton of the disposed card stocker can be attached/detached to/from the disposed card stocker, is made of paper or a plastic material, and can be disposed of or shredded while containing therein the cards to be disposed of.

3. The card disposal system according to claim 1, wherein the voiding means is configured to make a void hole or a notch on each of the cards.

4. The card disposal system according to claim 1, wherein the voiding means is configured such that a scrap from the void hole made on the card is disposed of in the disposed card carton together with the card to be disposed of, and with the scrap from the void hole being placed on the card to be disposed of.

5. The card disposal system according to claim 1, further comprising a printing means or a stamping means that exhibits a result of the determination made by the deck examination means on the disposed card carton of the disposed card stocker.

6. The card disposal system according to claim 1, wherein the disposed card carton is provided with a bar code different for each of the disposed card carton.

7. The card disposal system according to claim 6, further comprising a data management means for storing and managing the result of the determination made by the deck examination means based on each of the bar code.

8. The card disposal system according to claim 1, wherein a code with information on the number (rank) is added to the card such that the code is invisible under a normal condition;

the card disposal apparatus includes a disposed card information acquiring means for obtaining the code with information on the number (rank), the deck examination means has a function of obtaining information from the code relating to the number (rank) obtained by the disposed card information acquiring means, counting the number of cards for each number (rank) of the cards, and determining whether the cards that were placed in the discharge opening includes, for each number (rank), such number of cards that corresponds to a predetermined number of decks.

9. The card disposal system according to claim 8, wherein in said data management means, the result of determination by the deck examination means is stored in association with the bar code.

10. The card disposal system according to claim 1, wherein each of the cards further includes group information indicating a group of the card, and the card disposal apparatus comprises a authenticity determination means that acquires the group information of each card received from the discharge opening, compares that group information with a predetermined group information, and determines whether that group information matches the predetermined group information, thereby determining the authenticity of that cards.

11. The card disposal system according to claim 10, wherein in the voiding means, the number or the shape of the void hole or notch made on the card is differentiated depending on the result of the determination made by the authenticity determination means.

12. The card disposal system according to claim 10, wherein in the data management means, the result of the determination made by the authenticity determination means is stored in association with the bar code.

13. The card disposal system according to claim 10, wherein the group information is added to the back pattern or to the ink used to print the mark or code indicating the number (rank) or the type (suit) of the card, or is contained in the coating material, the anchor coating material or the ink on the card.

14. A card disposal system for disposing of cards that are housed in a card dealing apparatus (dealing shoe) placed on a game table and manually dealt onto the game table after the use thereof in a game, the card disposal system comprising:

a set of cards made up of a plurality of decks of cards that can be housed in the dealing shoe; and a card disposal apparatus for disposing the cards collected, wherein the card disposal apparatus includes:

a discharge opening for receiving a card to be disposed of;

a number counter for counting and storing the number of cards received from the discharge opening;

a voiding means for making a void hole or a notch on a card placed in the discharge opening;

a disposed card stocker for receiving a card that has passed through the voiding means in a disposed card carton; and a deck examination means for determining whether the number of cards placed in the discharged opening matches the number of cards corresponding to a predetermined number of decks, wherein the deck examination means adds every numbers of cards which have the same rank received by the discharge opening and examines at predetermined timing(s) at least whether or not each numbers of the cards which have the same rank match the numbers of the cards in every ranks sent by the dealing shoe through a communication means and outputs the mismatch of the result of the examination.

15. The card disposal system according to claim 14, wherein the set of cards made up of a plurality of decks of cards is a shuffled playing cards shuffled to have a unique arrangement order and packaged in a package and a uniquely identifiable shuffled card ID being different each other attached to each shuffled playing cards set as an ID code or RFID (IC tag); and the system has a barcode or RFID(IC tag) reader to reads the ID code.

16. The card disposal system according to claim 15, wherein the deck examination means outputs the mismatch of the result of the examination with the ID code of the shuffled playing cards.

* * * * *